US005855139A

United States Patent [19]

Ohmi et al.

[11] Patent Number: 5,855,139

[45] Date of Patent: Jan. 5, 1999

[54] STARTER MOUNTING STRUCTURE WITH SOUND INSULATION AND HEAT DISSIPATION

[75] Inventors: Masanori Ohmi, Anjo; Tsutomu Shiga, Nukata-gun, both of Japan

[73] Assignee: Nippondenso Co., Ltd., Kariya, Japan

[21] Appl. No.: 967,229

[22] Filed: Oct. 29, 1997

Related U.S. Application Data

[63] Continuation of Ser. No. 623,789, Mar. 29, 1996, abandoned.

[30] Foreign Application Priority Data

Mar. 30, 1995 [JP] Japan ..... 7-073051

[51] Int. Cl.[6] ..... F02N 11/00

[52] U.S. Cl. ..... 74/6; 74/606 R

[58] Field of Search ..... 74/6, 606 R, 606 A; 440/900

[56] References Cited

U.S. PATENT DOCUMENTS

| | | | |
|---|---|---|---|
| 2,623,186 | 12/1952 | Wilde | 74/606 A |
| 2,770,971 | 11/1956 | Doane | 74/6 |
| 2,944,508 | 7/1960 | Kiekhaefer | 74/6 |
| 3,084,561 | 4/1963 | Mattson | 74/6 |
| 3,140,617 | 7/1964 | Palmer | 74/6 |
| 4,155,266 | 5/1979 | Bradley | 74/6 |
| 4,846,124 | 7/1989 | Suzuki et al. | 123/195 P |
| 5,049,100 | 9/1991 | Yamamoto et al. | 440/77 |

FOREIGN PATENT DOCUMENTS 2-59247 4/1990 Japan .

*Primary Examiner*—Rodney H. Bonck
*Assistant Examiner*—David Fenstermacher
*Attorney, Agent, or Firm*—Pillsbury Madison & Sutro LLP

[57] ABSTRACT

A starter for cranking an engine is mounted within a heat conductive casing which surrounds a ring gear and a torque converter in such a manner that the starter is disposed radially inside the casing and directly contacts the inside surface of the casing. The casing insulates operational sound of the starter to enhance the quietness in a vehicle compartment. An air flow generated by the torque converter in the casing dissipates the heat from the starter to prevent excessive temperature rise of the starter. The heat generated in the starter is transferred outside through the direct contact between the starter and the casing, enhancing the heat-resisting characteristics of the starter.

10 Claims, 1 Drawing Sheet

FIGURE
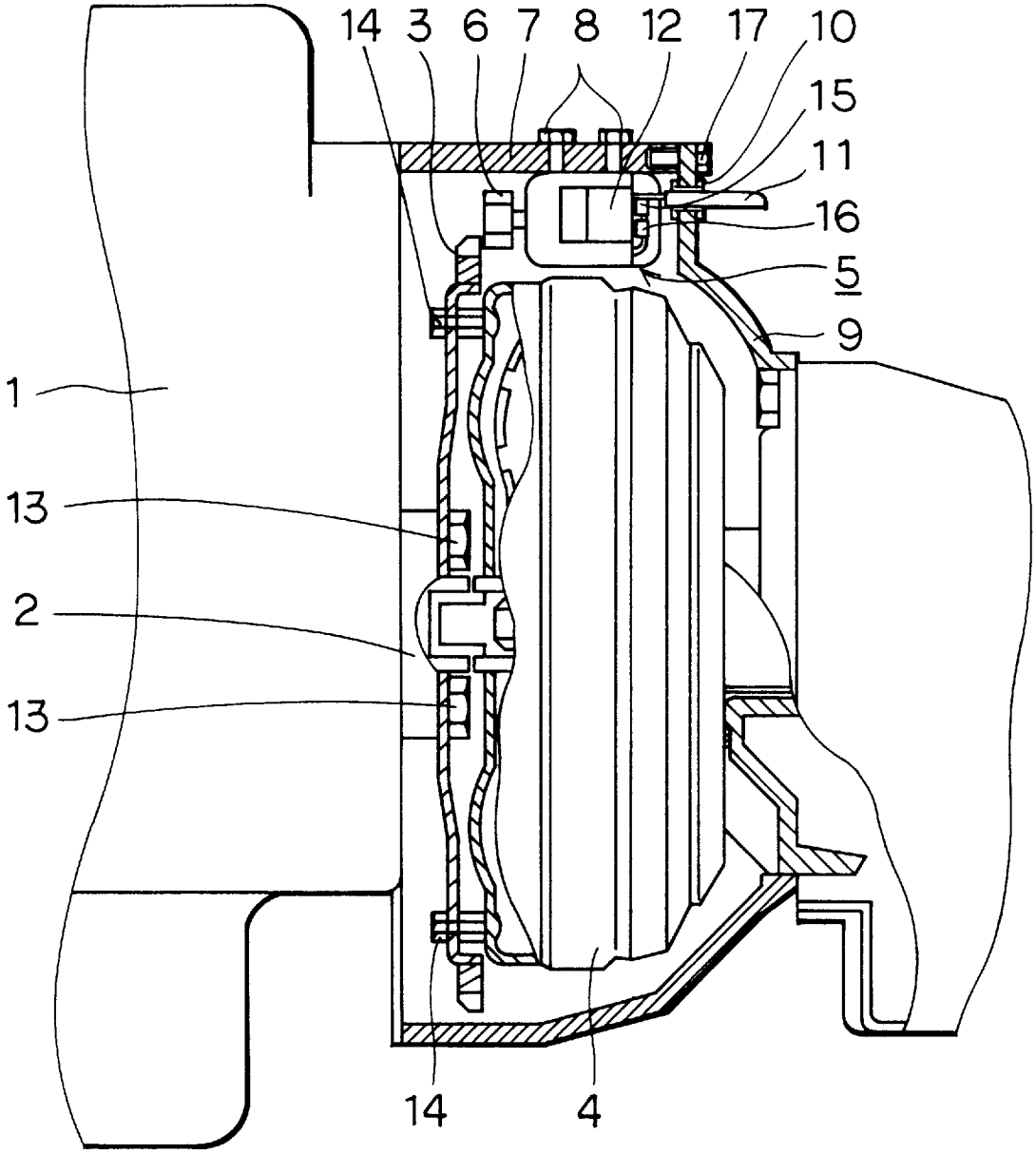

STARTER MOUNTING STRUCTURE WITH SOUND INSULATION AND HEAT DISSIPATION

This is a continuation of application Ser. No. 08/623,789, filed on Mar. 29, 1996, now abandoned.

BACKGROUND OF THE INVENTION

1. Field of the Invention

The present invention relates to an improvement in starter mounting structure and, more particularly, to a starter mounting structure in which a starter is mounted within a casing for sound insulation and heat dissipation.

2. Description of Related Art

It has been known conventionally from JP(U) 2-59247, for instance, to provide a casing fixed to a vehicle-mounted engine with a recess and to mount a starter in the recess, thus enhancing the rigidity of starter mounting portion. A cover is attached to cover the starter entirely and close the opening side of the recess. This cover functions as a sound insulating wall and enhances quietness in a vehicle compartment.

This mounting structure, however, is likely to undesirably transfer the heat generated by the engine to the starter, because the starter is sandwiched between the recess wall of the casing and the cover.

As a result, the heat transferred to the starter will not dissipate and will raise the temperature of the starter. This temperature rise in turn raises the electric resistance of electric windings within the starter, thus degrading starter performance and engine starting capability. In such a case as restarting the engine immediately after stopping a vehicle running, it may happen that the starter fails to restart the engine because the starter is still hot.

SUMMARY OF THE INVENTION

It is therefore a primary object of the present invention to provide an improved starter mounting structure.

It is a secondary object of the present invention to provide a starter mounting structure which enhances starter cooling while maintaining quietness in a vehicle compartment.

According to the present invention, a starter is mounted within a casing for a flywheel of a vehicle engine. The casing insulates the operational sound of the starter, maintaining quietness in the vehicle compartment. The flywheel with a ring gear of the engine (and a torque converter in some types of vehicles) mounted within the casing rotates with the engine and generates an air flow within the casing. This air flow, directed toward the starter, effectively dissipates the heat of the starter, thus preventing an excessive temperature rise of the starter and or cooling the starter.

Preferably, the casing is made of a good heat conductive material and the starter is mounted in direct, contact with the inner surface of the casing. The heat generated within the starter is effectively transferred to the casing, thus enhancing a heat-resisting characteristics of the starter.

Preferably, the starter is fixed to the casing at a plurality of locations in an axial direction thereof. This fixing structure provides better vibration-resisting characteristics for the starter than a cantilever type of fixing structure which provides a support at only one location.

Preferably, the starter is mounted radially outside the torque converter in the casing. The air flow generated radially outwardly by the rotation of the torque converter directly flows to the starter and enhances heat dissipation of the starter.

BRIEF DESCRIPTION OF THE DRAWINGS

Other objects and advantages of the present invention will become more apparent from the following description when read in conjunction with the accompanying drawing, in which:

the single figure is a schematic view illustrating, partially in cross section, a starter mounting structure according to a preferred embodiment of the present invention.

DETAILED DESCRIPTION OF PREFERRED EXEMPLARY EMBODIMENTS

Referring to the figure, an internal combustion engine 1 mounted in a vehicle (not shown) has a crankshaft 2 on one axial end of which a flywheel formed with a ring gear 3 on the outer circumference thereof is fixed by way of bolts 13. The ring gear 3 is engageable with a starter 5 via a pinion gear 6 of the starter 5. A torque converter 4 of an automatic transmission (not shown) is fixedly attached to the flywheel by bolts 14 with its central projection fitted into a central recess of the crankshaft 2.

The starter 5 which, is as known well, has an armature (not shown), overrunning clutch (not shown) and a pinion gear 6 in a disposed radially outside the torque converter 4 in so that the pinion gear 6 moves axially moves and engages the ring gear 3 to transmit the armature rotation for cranking the engine 1. The starter 5 is equipped with a magnet switch 12 which moves the pinion gear 6 for engagement with the ring gear 3 and supplies the electric power to the armature. The magnet switch 12 has a battery terminal 15 which is connected to a battery cable 11 and a motor terminal 16 which is electrically connected to the armature.

A casing 7, which covers or surrounds the flywheel and the torque converter 4 circumferentially, is made of a good heat conductive material such as aluminum and connected to the engine 1 integrally. The starter 5 is fixedly mounted onto the inside surface of the casing 7 by fixing means such as bolts 8 at a plurality of locations in the axial or front-rear direction (left-right direction in the figure) so that the starter 5 directly contacts the inner surface of the casing 7. The starter 5 is located radially outside the torque converter 4.

For simplifying electric wiring work of the battery cable 11 to the battery terminal 15 of the magnet switch 12, the casing 7 is formed with an opening at the rear portion (right side in the figure) of the starter 5. A cover 9 also made of good heat conductive material is used instead to close the rear opening of the casing 7. The cover 9 has a hole with a seal 10 for passing the battery cable 11 therethrough. Bolts 17 fixes the cover 9 to the casing 7.

According to the above-described construction, when the starter 5 is operated for engine cranking or starting with the electric power supplied through the magnetic switch 12, the starter 5 rotates the crankshaft 2 of the engine 1 through the engagement of the pinion gear 6 with the ring gear 3. Since the starter 5 is fully covered by the casing 7 including the cover 9, the operational or rotational sound of the starter 5 is insulated by the casing 7 and the quietness in the vehicle compartment is assured.

During normal engine rotation after the engine cranking by the starter 5, the ring gear 3 and the torque converter 4 rotates and generates air flow in a radially outward direction within the casing 7. This air flow, directly to the starter 5, dissipates heat of the starter 5 and prevents excessive temperature rise of starter 5, thus maintaining the required starter performance. Therefore, even when the starter 5 is operated again for engine restarting immediately after the engine stop, engine restarting will be enabled without fail.

Although the starter 5 has the armature therein with electric windings which generate heat during operation, such heat will be transferred to the casing 7 through the direct contact portion between the starter 5 and the casing 7. This heat transfer also reduces the excessive temperature rise of the starter 5, enhancing the heat-resisting characteristics of the starter 5.

Further, fixing the starter 5 to the casing 7 at plural locations in the axial direction reduces vibration of the starter 5, thus enhancing the vibration-resisting characteristics.

In the above-described embodiment, the starter mounting structure may also be applied to a vehicle engine with a manual transmission which has no torque converter but has a clutch mechanism instead within the casing 7.

In addition, the casing 7 or the cover 9 may be configured so that the rear end of the starter 5 and the battery terminal 15 are exposed outside the casing 7 and cover 9, with the cover 9 supporting the rear end of the starter 5 thereon. In this instance, the wiring work of the battery cable 11 to the magnet switch 12 will be simplified, the temperature rise of the starter 5 will be suppressed more effectively, and the bolt 8 which fixes the rear portion of the starter 5 to the casing 7 may be obviated.

The present invention should not be limited to the above-described embodiment and modifications, but may be modified in other ways without departing from the spirit and scope of the invention.

What is claimed is:

1. In an engine having a ring gear, a member rotatable with the ring gear, and a starter, a structure for mounting the starter to the engine, comprising:

a casing provided to cover the ring gear and the rotatable member;

the starter having a pinion gear engageable with the ring gear for engine cranking, the starter being fixed within the casing, said starter being disposed within the casing so that a starter motor thereof is in opposed facing relation to said rotatable member whereby radial air flow produced by said rotatable member directly cools said starter motor, wherein the rotatable member includes a torque converter; and the starter is disposed radially outside of the torque converter.

2. A structure according to claim 1, wherein:

the casing is made of a heat conductive material; and the starter is fixed in direct contact with an inside surface of the casing.

3. A structure according to claim 1, wherein:

the starter is fixed to the casing at a plurality of locations along a length of the casing.

4. A structure according to claim 1, wherein:

the casing extends axially from the engine and in parallel with the starter so as to circumferentially cover the ring gear and the rotatable member, the casing having an opening through which a battery cable extends axially for connection with a battery.

5. A structure according to claim 2, wherein:

the starter is fixed to the casing at a plurality of locations along a length of the casing.

6. In an engine having a crankshaft, a ring gear driven by the crankshaft, a member rotatable with the ring gear, and a starter having an armature and a pinion gear engageable with the ring gear; a structure for mounting the starter to the engine, comprising:

a casing provided to cover the ring gear and the rotatable member;

the starter being arranged in the casing with the pinion gear being arranged more closely to the engine in an axial direction of the crankshaft than other parts of the starter so that said other parts of the starter are in opposed facing relation to the rotatable member, whereby radial air flow produced by the rotatable member directly cools at least said other parts of the starter.

7. A structure according to claim 6, wherein:

the starter is fixed in contact with an inside surface of the casing.

8. A structure according to claim 6, wherein:

the rotatable member is disposed more remotely from the engine than the ring gear.

9. A structure according to claim 8, wherein:

the rotatable member includes a torque converter.

10. In an engine having a crankshaft, a ring gear driven by the crankshaft, a member rotatable with the ring gear and disposed more remotely from the crankshaft than the ring gear in an axial direction of the crankshaft, and a starter having an armature and an pinion gear engageable with the ring gear; a structure for mounting the starter to the engine, comprising:

a casing provided to cover the ring gear and the rotatable member;

the starter being fixed to an inside surface of the casing with the pinion gear being arranged more closely to the crankshaft in the axial direction of the crankshaft than other parts of the starter so that said other parts of the starter are in radially opposed facing relation to the rotatable member whereby radial air flow produced by the rotatable member directly cools at least said other parts of the starter.

* * * * *